United States Patent [19]

Wassermann

[11] 4,014,258

[45] Mar. 29, 1977

[54] HIGH SPEED PRINTING APPARATUS

[76] Inventor: Carl I. Wassermann, 45 Hill Park Ave., Great Neck, N.Y. 11021

[22] Filed: Aug. 29, 1975

[21] Appl. No.: 608,902

[52] U.S. Cl. ..... 101/93.29; 101/93.34; 101/93.48

[51] Int. Cl.[2] ..... B41J 9/38

[58] Field of Search ... 101/111, 93.14, 93.28–93.34, 101/93.48

[56] References Cited

UNITED STATES PATENTS

| | | | |
|---|---|---|---|
| 3,072,045 | 1/1963 | Goin | 101/93.29 |
| 3,087,421 | 4/1963 | Irwin et al. | 101/93.29 |
| 3,172,352 | 3/1965 | Helms | 101/93.34 |
| 3,282,203 | 11/1966 | Kalbach et al. | 101/93.33 |
| 3,285,166 | 11/1966 | Helms et al. | 101/93.34 |
| 3,735,698 | 5/1973 | Lenders et al. | 101/93.29 X |
| 3,780,650 | 12/1973 | Meier | 101/93.48 |

*Primary Examiner*—Edward M. Coven

[57] ABSTRACT

Equipment for use in a high speed line printer or the like is disclosed which includes a series of independently actuatable print hammers mounted for reciprocation in adjacent side-by-side paths. All hammers are mounted on current carrying spring supports. The shank of each hammer carries a coil which is positioned with the turns of each coil lying in planes which are normal to fields generated by rectangular permanent magnets, e.g. sintered ceramic magnets, which are disposed on opposite sides of the hammers, and which have zones of opposite polarity extending transversely of the series of hammers. The coils on the hammers are located within portions of the fields generated by said zones of opposite polarity so that the hammers are individually driven along their paths upon delivery of an electrical impulse to the coils carried by the selected hammers. Also disclosed is an arrangement of the coils on the hammers whereby coils are mounted in a staggered array with the coils on adjacent hammers disposed on opposite sides of the hammer shanks. The coils adjacent one another on the same side of the hammers are arranged in stepwise fashions longitudinally of the hammers. All hammer supports are shown as being mounted on common base members which also carry a printed circuit board which provides the control circuit for selectively impulsing the individual hammers in the series.

16 Claims, 5 Drawing Figures

HIGH SPEED PRINTING APPARATUS

BACKGROUND OF THE INVENTION

This invention relates to electromechanically actuated impact devices for use in high speed printers, punches or the like; more particularly to a modular construction of magnetically driven impact devices and to improvements in actuator construction and in the arrangement of magnets and electrical actuating means for driving impact devices.

Although in its broader aspects the invention is not limited thereto, the various features of the invention have particular applicability to high speed line printers of the impact type.

As is well known in the art, high speed line printers of the impact type typically employ a series of print hammers disposed along a print line in side-by-side relationship, there being one print hammer for each location at which information is to be printed on a line. In order to provide a readable format, the column or print spacing along a print line in a typical computer print-out should be about 1/10 of an inch or even less. A number of problems arise in the design of hammers which are close enough together to meet this spacing limitation and yet are capable of operating reliably over prolonged periods of time at the high speeds demanded by the data processing industry.

In accordance with one body of prior art, print hammers of the kind referred to are individually actuated by means of solenoids which impart movement to the hammers through linkages or mechanically moveable striker members. Such arrangements are limited to use in relatively slow speed applications due to lost motion in the mechanical connections as well as the losses due to friction and inertia. In addition, in high speed applications, the solenoids must be relatively large and when an assembly of solenoid and connecting linkages is taken into account, complex spacing, alignment, assembly and servicing problems arise. Relatively large and expensive power supplies are required for operation of the solenoids. Moreover, at the speeds required of printers of the type to which a preferred embodiment of the invention relates, overheating of the solenoids becomes a significant problem, requiring that means for ventilating and cooling be provided.

Significant advances in impact printers are disclosed in Irwin et al U.S. Pat. No. 3,087,421 and Kalbach et al. U.S. Pat. No. 3,282,203. According to these patents, printing speeds of over a thousand lines per minute are achieved by the use of hammers carrying coils which are located in gaps formed between a series of spaced apart permanent magnets, with the faces of the magnets forming the gaps being of opposite polarity so that a field extends across each gap. According to these patents, one gap is provided for each hammer and the gaps extend in the direction of movement of the hammers so that current impulses through the coils cause movement of the hammers against an impact surface.

In order to maintain a print spacing of at least 10 characters per inch, the prior art described just above makes use of a plurality of rather small, thin flat magnets, which are separated by narrow gaps. The magnets are staggered above and below the print line in order to maintain the gaps on the 1/10 of an inch centers dictated by a 10 character per inch print spacing and are usually arranged so that adjacent hammers are suspended on supports which are alternately located above and below the magnets in order to provide clearance between the supports and magnets. Obviously, a drawback to the approach shown in these patents is that it requires a very large number of magnets which must closely and accurately spaced in side-by-side relationship. Flat coils must be carefully made in order to fit within the narrow spaces. Perfect alignment of the parts is needed in order to limit frictional contact of the flat coil with the adjacent magnet faces. Since the coils must be extremely thin, the number of turns and the size of wire on each coil is limited. Typically, thin aluminum foil is used for the coil wire. To compensate for the limited number of turns, the magnets used have a relatively high flux density and a relatively high current is passed through the aluminum foil material to provide the needed driving force. Because of the high current values, the coils which are confined in the narrow gaps tend to heat up. Hysterisis losses and eddy currents cause further heating. In addition, the eddy currents delay the build-up of the magnetic field. A relatively large power supply must be use to compensate for the thin coils and this disproportionately increases the cost of the equipment.

SUMMARY AND OBJECTS OF THE INVENTION

The present invention provides improvements in assembly, operational characteristics and ease of maintenance over the prior art print hammer assemblies described above. According to the invention, the hammers comprise elongated body members formed of a plastic material such as polycarbonate with an impact tip adjacent one end of each hammer. As in the prior art, the hammers are driven in adjacent side-by-side paths against an impact surface whereby impressions are made at the print locations on a print line spaced adjacent the hammer tips.

Each hammer shank carries a coil which is positioned within a magnetic field preferably generated by a permanent magnet means so that energization of selected coils drives the appropriate hammers against an impact surface. Hammers are grouped together in modules of novel construction. Another feature of the invention is that the field generating means comprises elongated permanent magnets which extend transversely of modules of the hammers so that fields are generated which interact with the coils of a plurality of hammers. More specifically, the magnets are magnetized so that field portions extend normal to the planes in which the coils are wound, in zones which extend transversely of the group of hammers. The magnetic fields may be generated in various ways, as for example, by transversely extending bar magnets located on opposite sides of the coils or by a single slab magnet on one side of the coils. The fields may extend from one magnet to the next or between adjacent zones of opposite polarity on the same magnet. In a preferred embodiment of the invention slab magnets of rectangular cross section extend transversely of a plurality of hammer modules making up banks or 80 of 120 hammers.

An important object of the invention is the provision of a magnetically driven hammer assembly which incorporates the improvements set forth above.

Another object of the invention is the provision of a novel hammer module and magnet assembly which leads to a reduction in production costs and fabrication time by eliminating the requirement for precision transverse alignment of the hammers relative to the magnets with which they cooperate.

A further object of the invention is the provision of a magnetically operated linear actuator assembly comprising coils mounted on moveable actuators, in which the coils are not confined within narrow gaps between magnets so that large coil for the actuators may be employed, even though the actuators are mounted in close side-by-side relationship.

A still further object of the invention is the provision of a magnetically driven actuator assembly, wherein slab magnets generate magnetic fields which are common to a series of side-by-side actuators.

A still further object of the invention is the provision of a hammer and magnet assembly of compact dimension and simplified construction, which involves fewer moving parts, use of simplified and relatively low cost coils and makes use of magnet slabs which generate fields common to the several coils on of the hammers.

A still further object of the invention is the provision of an assembly for use in a printer wherein substantial portions of hammer bodies, hammer supporting structure and frame are formed of moldable plastic materials.

Yet another object of the invention is the provision of a magnetically driven actuator assembly incorporating sintered ceramic magnets for driving a multiplicity of side-by-side actuators.

A still further object of the invention is a printer which has improved performance characteristics over the prior art, at substantially lower manufacturing costs.

The foregoing and other objects and advantages of the invention will become apparent upon reference to the following detailed description of a preferred embodiment of the invention, as illustrated in the accompanying drawings in which.

Figure 1:
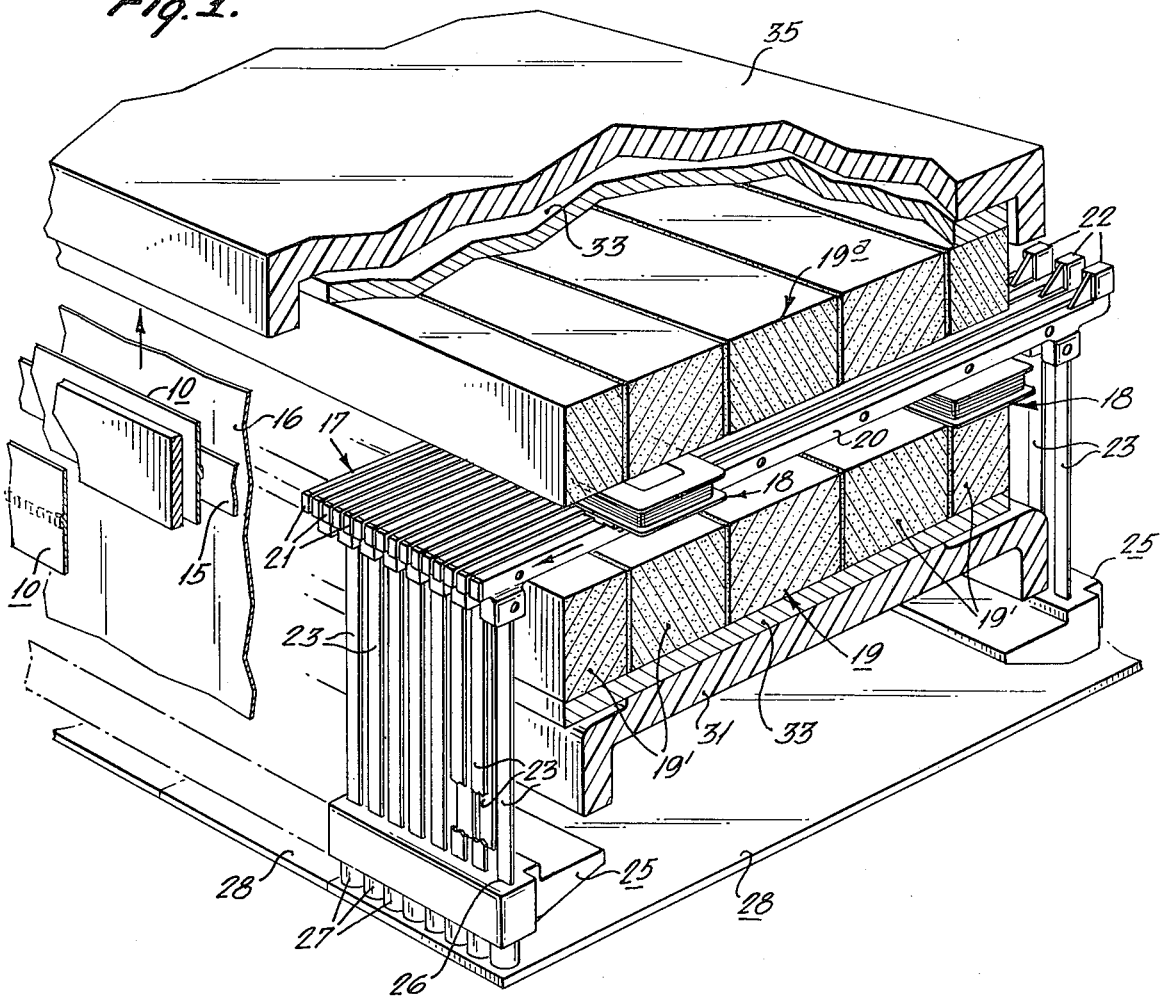
FIG. 1 is a perspective view of a printer, with certain parts omitted for clarity of illustration, the principles of the present invention.

Referring now to the drawings, by way of background, the illustrative embodiment of the invention is incorporated in a high speed back printer such as a back printer in which alpha numeric type characters are typically embossed on an endless metal belt 10 by a chemical milling process. As is understood by those in the art, belt 10 is carried on rollers 11 and 12 one of which is continually driven so that the characters move along a print line during printing operations by drive means including a motor 13 and drive belt 14. A ink ribbon 15 is interposed between the type characters and the print medium which is typically a web of paper 16 which moves in the direction indicated by the arrow in FIG. 1 by means of tractors not shown, but of conventional construction. As is known by those in the art, such printers print on the paper a line at a time by the operation of plural print hammers arranged transversely of the line at equidistantly spaced locations. When type characters to be printed arrive at given print spaces, actuation of the hammers drives the record medium against the band and causes the characters to be printed. When a complete line is printed under control of a storage device which operates with means for tracking the locations of the characters on the belt, the record medium is advanced to the next line and the process is repeated.

Although a preferred application of the invention is in combination with a back printer using a continuous belt as just described, it should be understood that the principles of the invention are applicable to front printers generally including, drum and matrix printers, as well as to punches or the like wherein a plurality hammers or similar actuating devices are employed in a side-by-side array.

As indicated above, printing at any given type location is affected by driving hammers against an impact surface so as to cause an impression of the characters to be printed on the record medium. In a typical line printer, a total of 10 characters per inch or more are desirably printed on a line so that the hammers must be spaced in an extremely close side-by-side relationship if one hammer per print position is to be provided. The several features of the present invention cooperate to provide an assembly in which magnetically driven actuators can be easily mounted at 1/10 of an inch intervals or less, at lower cost and with fewer assembly problems than has heretofore been the case.

Figure 4:
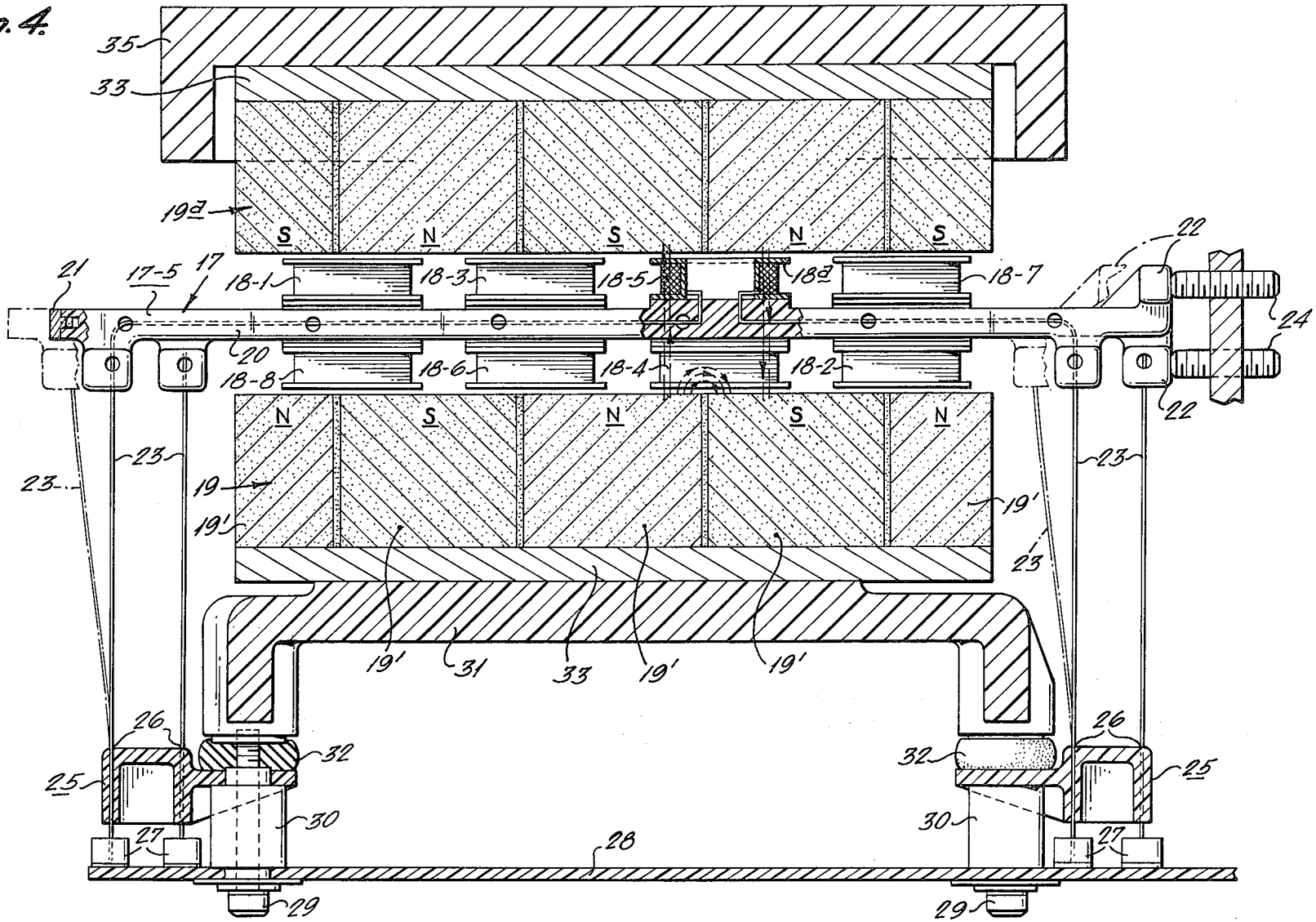
FIG. 4 is an sectional view on an enlarged scale with respect to FIGS. 1–3, of the hammer assembly shown in FIGS. 1 and 2, taken on line 4—4 of FIG. 3.

Referring to the drawings, the invention generally comprises a bank or series of hammers 17, each carrying a coil 18 which is located in a magnetic field which is common to a number of the coils. Preferably the fields are generated by permanent magnet means which include an elongated magnet slab members of an isotropic material generally indicated at 19 which extend transversely of the series of hammers. The surfaces of the magnet slab members which face the coil are polarized in zones of opposite polarity with the zones extending lengthwise of the slabs. As best shown in FIG. 4, where the field generated by adjacent zones is schematically represented, the coils are in magnetic field portions which are normal to the polarized surfaces and to the planes in which the coils are wound. Current impulses of appropriate polarity through a coil create an interaction of fields which drives the energized coil at a right angle to the field in the direction substantially as indicated by the arrows appearing on the hammers in FIGS. 1 and 4.

Each hammer includes an elongated shank or body member 20 preferably formed of non-magnetic material. Although other materials may be employed, excellent results have been achieved with hammers made of molded polycarbonate such as sold by General Electric Company under the trademark "LEXAN". Each hammer 17 is provided with an impact tip 21 of impact resistant metal such as steel adjacent one end. The opposite end is provided with an enlarged projection or stop lug 22.

Although other mounting means may be employed, hammers 17 are preferably mounted for axial movement on pairs of flexure members 23 which bias the hammers so that lugs 22 rest against rebound stops 24.

Preferably the flexure members 23 are flat springs formed of steel or other electrically conductive material and function as current conductors to the electric coils carried by each hammer. In making a preferred form of hammer, the springs 23 are placed in molds for the hammers so that when a mold is filled with resin the springs are molded integrally with the shank 20 so as to form a unitary assembly.

The use of flat wire gives the entire hammer assembly lateral stability and furthermore imparts resistance to bending of the elongated hammer body.

As best illustrated in FIGS. 1 and 4, the rebound stop projections or lugs 22 are molded on the ends of the hammers opposite the impact tips so as to strike the ends of rebound stop set screws 24 when the hammers rebound following impact against the record medium. The rebound stop set screw 24 are preferably formed of an energy absorptive material so that kinetic energy remaining in the hammers is rapidly absorbed and the hammer comes to rest against its stop before the next operating cycle. To provide clearance of parts, the stop projections and the set screw with which they cooperate are preferably alternately spaced upwardly or downwardly from the print line for reasons explained below.

Figure 2:
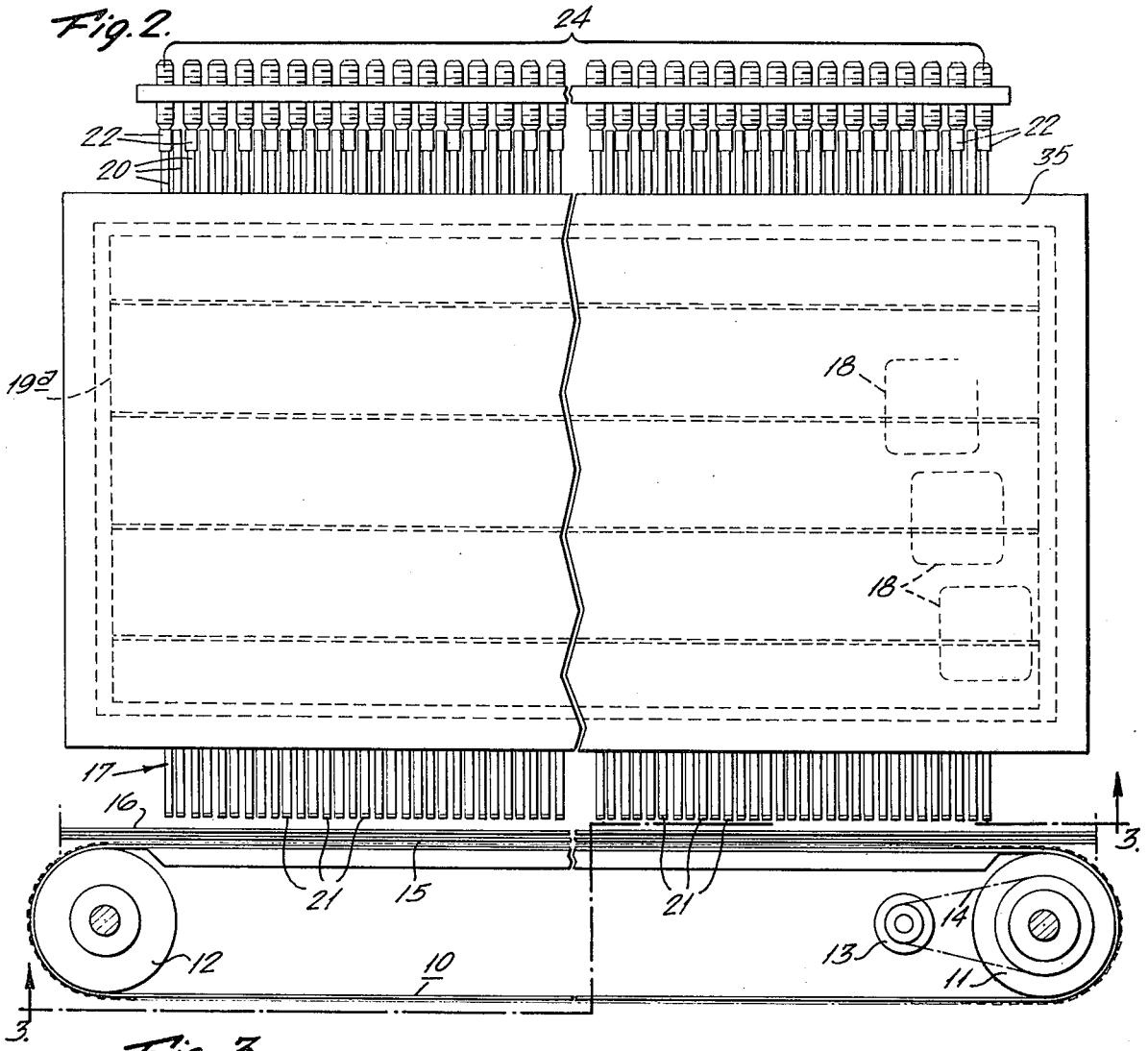
FIG. 2 is a plan view; with certain parts being omitted, of the apparatus shown in a FIG. 1.

As shown in FIGS. 1 and 2, the invention permits the mounting of a side-by-side array of hammers on a unitary base or support structure which may be formed of a molded plastic material thereby forming modular assemblies which may be conveniently mounted relatively to the magnets which generate the fields for operating the hammer coils. In the illustrative embodiment, 16 hammers are mounted as a unit on each base structure which is mounted beneath the hammers on a frame as described below.

The base structure preferably comprises molded elongated support elements 25 each of which is provided with two rows of slots 26 which receive and support the ends of the springs 23. As viewed in FIG. 4, the two spring supports for one hammer are fit into the leftmost slots 26 of the two support elements 25 whereas the two spring supports of the next hammer fit into slots 26 of the right-hand row of slots. The spring supports preferably project from the bottom of the support elements 25. The ends thereof form the male parts of electrical connectors and plug into female parts 27 mounted on a printed circuit board 28. Circuit board 28 carries the circuitry for the delivery of drive impulses to the coils of the individual hammers 17.

In the illustrative embodiment, a separate circuit board 28 is provided for each module of 16 hammers. Each board is secured to the support elements 25 by fasteners such as bolts 29. Spacing collars 30 establish the proper spacial relationship between the boards and the support elements 25. The bolts 29 secure the entire assembly to an elongated generally inverted U-shaped frame member 31 also formed of molded plastic material. Spacing washers 32 are provided between the frame 31 and the support elements 25. A magnet slab member 19 of rectangular cross section extends transversely of all hammer modules and rests on the frame member 31 and is secured thereto by any suitable means.

Figure 3:
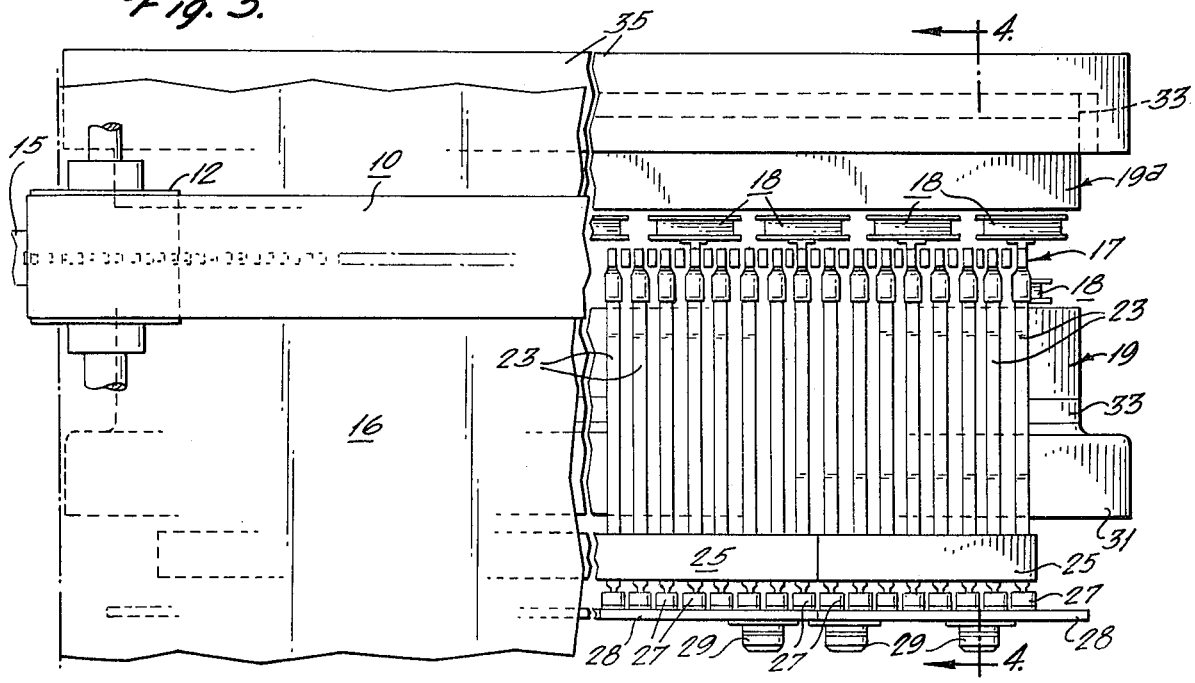
FIG. 3 is a sectional view, taken along line 3—3 of FIG. 2, with certain portions of structure omitted.

FIGS. 2 and 3 illustrate certain hammer features which contribute to a compact and rugged hammer assembly, capable of printing 10 characters per inch with a hammer for each print location, without crowding the coils or creating problems of interference with other moving parts. From FIGS. 2 and 3, it should be noted that the impact tip and the shank of each hammer can be relatively thin, the tip being just thick enough to span any character to be printed at the print location. For added strength where required, certain critical parts of the hammers are reinforced by forming them of material which is thicker in section than the width of the print location. Examples of such portions are the rebound lugs 22. In addition, reinforcement is desirable at the points where the flexure members or springs 23 enter the shank, since these are points which are subject to relatively high stresses, and are desirably made thicker than the width of a print space. The downwardly extending flat spring supports 23 are also relatively wide so as to maximize resistance to transverse bending of the hammers.

In order to provide clearance between adjacent hammers, while maintaining the desired spacing between adjacent hammers in the array, parts on one hammer which are thicker than a column dimension are offset with respect to the same parts on the adjacent hammer and are offset with respect to the longitudinal axes of the hammers. As shown in FIGS. 1 and 4 the rebound stops 22 on every other hammer are located above the long axis of the shanks of the hammers. On adjacent hammers the enlarged section at which the rear spring support enter the hammer serves as the rebound stop.

In positioning the coils 18 within the magnetic fields it is important that the coils should be located within portions of the fields which are substantially normal to the planes in which the coils are wound. In the preferred embodiment of the invention, the coils are located in planes which are substantially parallel to a plane extending through the longitudinal axes of all hammers in the bank of hammers. With this orientation, the coils are not restricted or confined within a narrow gap between adjacent magnet faces so that their location lengthwise of the magnet faces is not a critical matter.

As noted above, the spring supports 23 may also serve as the conductive elements for supplying current to the coils. In the preferred embodiment, as seen in FIG. 4, the spring supports are bent internally of the body and provide a pair of tips which project outside of the body into an opening in the coil frame or bobbin 18a on which the wire of the coil is wound. Each bobbin is cemented or otherwise secured in known manner to the shank of each hammer, with the coil ends connected to the protruding tips of the spring supports.

Figure 5:
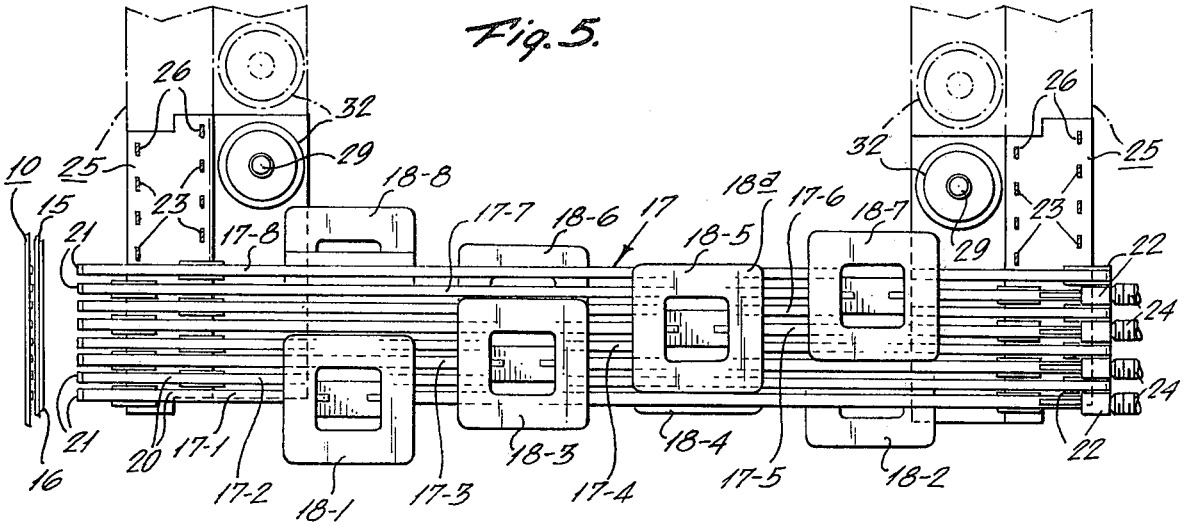
FIG. 5 is a plan view, on an enlarged scale with respect to FIGS. 1–3, of a hammer module assembly with certain hammers omitted, showing the mounting pattern of coils on a preferred hammers in the module.

Since the driving force for each of the hammers is a function of flux density, current, length of wire normal to the field and number of turns, the desired driving force for a given flux density may be achieved with the invention by minimizing current and maximizing coil dimensions and number of turns of wire so as to reduce the amount of heat generated and the size of the power supply used for driving the coils. An aspect of the invention which permits this is the orientation of the flat field generating faces of the magnetic field generating means so that polarized zones extends transversely series of coils. The compact side-by-side relationship of parts is maintained without sacrifice of coil size by a stepped mounting pattern of the coils on the hammers and by mounting adjacent coils on opposite sides of the hammers. As can be best seen in FIGS. 1 and 4, the preferred embodiment of the invention provides for a second magnet slab 19a mounted on a frame 33 so that the slab is suspended in spaced relationship above the hammers. A typical mounting pattern of the coils is illustrated in FIG. 5, wherein the hammers are designated 17-1 through 17-8 respectively and the coils for those hammers are designated 18-1 through 18-8. The coils on hammers 17-1, 3, 5 and 7 may be located on top of the hammers and the coils on hammers 17-2 4, 6 and 8 are located below the hammers. In addition, the series of coils on one side of the hammers are arranged in a stepped pattern relatively to one another. With the arrangement, a high degree of flexibility as to coil size and number of turns is available. Since the coils are not confined within narrow slots, dimensioning of the coils is not critical and the coils can be made from relatively inexpensive materials.

Although the magnetic field generating means used in carrying out the invention may assume various forms, it is important that there be adjacent zones of opposite polarity which extend transversely of the print hammers. The field generating means comprises magnets preferably formed of an anisotropic material with fields generated by the magnets having regions which are normal to the planes of the coils. The desired fields may be provided in various ways. The preferred arrangement, as shown in the drawings, comprises ceramic permanent magnet slab structure 19 made up of a purality of side-by-side bars or sections 19[1] of a ceramic magnet material of rectangular cross section. The ceramic magnet bars 19[1] are mounted on a support or keeper plate 33. Flux gaps separate each bar from the adjacent bar. As shown in the drawings, the surfaces facing the coils are polarized so that the surfaces on adjacent bars are of opposite polarity with respect to one another.

Various alternative forms of magnet assembly may be provided for while accomplishing certain important principles of the invention. For example, only a single magnetic slab structure 19 as described above may be used in conjunction with a magnetic keeper plate spaced on the opposite side of the coils from the magnetic slab so as to provide the desired magnetic field. The magnetic slab may be a unitary slab wherein the zones of opposite polarity are not separated by physical gaps but by nonmagnetic regions. The desired magnetic field may be provided by slabs having a horseshoe configuration or by a series of horseshoe shaped magnets secured in a unitary assembly. In all such configurations, the magnetic fields generated are common to a plurality of coils.

Preferably, and as shown in the drawings, the field generating means includes a second magnetic slab 19-a which is positioned above the hammers. Slab 19-a is of similar construction to slab 19 and is secured to a support member 35 with the exception that the magnetized regions facing the coils are of opposite polarity with respect to the regions immediately beneath them on slab 19.

In FIG. 4, a portion of the magnetic field in the region of coils 18-4 and 18-5 is shown. As can be seen, lines of force pass from the north pole on a part of the magnet structure beneath and to the left of coils 18-4 and 18-5 as those coils are illustrated, through the coil, to the south pole of the part of magnet structure immediately above. The field also extends downwardly from the north pole of the upper magnetized part across the flux gap, through the coils to the south pole of the region immediately below. By application of Lenz's law, a current impulse of proper polarity through a coil can be seen to drive that coil from the position indicated in FIG. 4 to the left so that an imprint is made on the record medium. Following impact, the springs permit return of the energized hammer to the right where any kinetic energy remaining in the hammer is absorbed by the impact stop for that hammer.

It can be appreciated that the polarization of the magnet members with transversely extending zones of opposite polarity eliminates a difficult problem of transverse alignment of the coils relative to the magnet members. With the invention, the series of hammers may be shifted transversely on the slab magnets without effect on the operation of the hammers, so that transverse tolerances of hammers need not be accurately maintained.

The magnetic structure itself is extremely simple as compared with prior art since two unitary slabs can be provided for driving all hammers. The use of sintered ceramic permanent magnets provides high flux densities at low cost and permits a relatively large air gap between top and bottom magnets with ample clearance for relatively large coils.

I claim:

1. In a printer or the like, a plurality of hammers each having an elongated shank with an impact tip adjacent one end, means mounting said hammers for movement in side-by-side parallel paths along the longitudinal axes of said shanks whereby impressions are made on a surface adjacent the tips, a coil on each hammer shank for receiving electrical impulses, said coil being positioned with the turns lying in planes which are parallel to the plane containing said parallel paths of hammer movement, magnetic field generating means for generating fields in continuous zones extending transversely of said plurality of hammers with field portions extending normally to the plane which contains said parallel paths of hammer movement, and means mounting said coils within said magnetic field portions whereby said electrical impulses in said coils interact with said field portions to propel said hammers along said parallel paths.

2. In a printer according to claim 1, wherein said magnetic field generating means comprises a magnet member having a plurality of elongated permanent magnet portions extending transversely of said hammers, a transversely extending flux gap separating each of said portions, the surfaces of said portions adjacent the flux gaps being of opposite polarity, with the field created by the opposite poles having portions extending substantially normal to the planes in which said coils are would and wherein said coils are positioned within said normally extending field portions whereby an electical impulse to a coil imparts movement to its hammer along its longitudinal path.

3. In a printer according to claim 2 wherein said permanent magnet portions are separated by a plurality of transversely extending flux gaps and wherein the coils carried by said hammers are located in a staggered array with the coils carried by adjacent hammers being positioned in the field portions across different ones of said flux gaps.

4. In a printer according to claim 1, wherein said magnetic field generating means comprises first and second magnet members and wherein said magnet members extend transversely of said hammers on opposite sides thereof.

5. In a printer according to claim 4 wherein the coils carried by said hammers are alternately adjacent the first and second of said magnet members.

6. In a printer according to claim 4, wherein each of said magnet members is comprised of a plurality of adjacent sections, said adjacent sections being of opposite polarity, said sections extending transversely of the series of hammers to provide fields common to a plurality of coils, and wherein the coils which are in lateral proximity to one another are adjacent to different ones of said sections.

7. Apparatus according to claim 1 wherein the transverse dimension of each of said coils is greater than the transverse dimension of each hammer shank and the coils are displaced relatively longitudinally on the shanks on which they are mounted so the overlapping portions clear the shanks of adjacent hammers.

8. A printer according to claim 7 wherein said magnetic field generating means comprises a pair of magnetic field generating members being disposed on opposite sides of the plane within which said hammer shanks move, each of said magnetic field generating members having a plurality of polarized regions extending transversely of said series of hammers with north and south poles adjacent one another and the two magnetic field members having opposite pole regions adjacent one another, and means positioning the coils of the hammers in the fields gererated by said regions of opposite of the two magnet members.

9. A printer according to claim 1 wherein said magnetic field generating means comprises polarized regions of an anisotropic material

10. A printer according to claim 9 wherein said magnetic field generating means comprises a plurality of pairs of oppositely polarized regions extending parallel to one another, and wherein coils adjacent one another are disposed in the field portions provided by different ones of said pairs of regions.

11. A printer according to claim 10 wherein said magnetic field generating means comprises at least three pairs of oppositely polarized regions and wherein said coils are positioned relatively to one another in step-like arrays.

12. A modular hammer assembly for use in a printer for printing in a plurality of side-by-side columns of fixed dimension along a print line, a hammer for each of said columns, each hammer having an elongated shank, a metallic impact tip at one end of said shank, the tip having a support arm embedded in the shank, said tip having a width sufficient to span any character to be printed but being less than the width of a column on said print line, a pair of spring supports for each hammer, the two supports lying in a common plane, said supports providing freedom for reciprocation of the hammer shank in a path paralleling said plane, means for actuating each hammer comprising a coil mounted on each hammer, said coil being wound in planes which are parallel to a plane in which the longitudinal axes of said hammer shanks lie, and having a transverse dimension in the plane of winding which is greater than the hammer spacing, and means mounting the coils in offset relationship with respect to one another and with respect to the shanks whereby clearance for movement toward and away from said print line is provided.

13. A modular hammer assembly comprising a series of hammers mounted in side-by-side relationship, each hammer having an elongated shank and pairs of first and second upstanding spring supports individual thereto for supporting said hammers for movement in paths extending along the longitudinal axes of said shanks, a first elongated support element for supporting the first spring supports of said pairs in side-by-side relationship, a second elongated support element for supporting the second spring supports of said pairs in side-by-side relationship, driving means for moving said hammers in said paths comprising a driving coil individual to each hammer, said coils being wound in planes which extend, said coils having a transverse dimension substantially greater than the hammer spacing, means mounting the coils on the hammer shanks with the coils on adjacent shanks being offset with respect to said shanks and with respect to one another along said shanks to provide a clearance space sufficient to prevent interference therebetween upon hammer movement along said paths.

14. A modular hammer assembly according to claim 13, wherein the coils on adjacent hammers are mounted on opposite sides of said shanks.

15. A hammer assembly according to claim 13 wherein said driving means further comprises a permanent magnet means of anisotropic material extending transversely of said series of hammers in proximity to said coils, said permanent magnet means being positioned to generate magnetic field portions extending normally to the planes in which said coils are wound, said coils being mounted within said field portions.

16. A modular assembly according to claim 13 wherein the coils on each side of the hammers are mounted in stepwise patterns.

* * * * *

UNITED STATES PATENT AND TRADEMARK OFFICE

CERTIFICATE OF CORRECTION

PATENT NO. : 4,014,258

DATED : March 29, 1977

INVENTOR(S) : Carl I. Wassermann

It is certified that error appears in the above-identified patent and that said Letters Patent are hereby corrected as shown below:

Column 2, line 21, "use" should be --used--.

Column 2, line 59, before 80 "or" should be --of--; and before 120 "of" should be --or--.

Column 3, line 17, "coils on" should be before "several".

Column 3, line 40, "a" should be omitted.

Column 4, line 37, "coil" should be --coils--.

Column 5, line 11, "screw" should be --screws--.

Column 5, line 16, "screw" should be --screws--.

Column 6, line 21, "enter" should be --enters--.

Column 6, line 68, "," should be inserted between "2" and "4".

Column 8, line 45, "would" should be --wound--.

Column 9, line 20, "gererated" should be --generated--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*